United States Patent [19]

Welch

[11] 4,336,690

[45] Jun. 29, 1982

[54] CRYOGENIC PUMP WITH RADIATION SHIELD

[75] Inventor: Kimo M. Welch, Mountain View, Calif.

[73] Assignee: Varian Associates, Inc., Palo Alto, Calif.

[21] Appl. No.: 234,512

[22] Filed: Feb. 17, 1981

Related U.S. Application Data

[63] Continuation of Ser. No. 79,860, Sep. 28, 1979, abandoned.

[51] Int. Cl.[3] ..... B01D 8/00

[52] U.S. Cl. ..... 62/55.5; 62/268; 55/269; 417/901

[58] Field of Search ..... 62/55.5, 100, 268; 417/901; 55/269

[56] References Cited

U.S. PATENT DOCUMENTS

| | | | |
|---|---|---|---|
| 3,282,058 | 11/1966 | Venema et al. | 62/55.5 |
| 3,579,997 | 5/1971 | Rapinat | 62/55.5 |
| 3,579,998 | 5/1971 | Thibault et al. | 62/55.5 |
| 4,121,430 | 10/1978 | Bachler et al. | 62/55.5 |
| 4,150,549 | 4/1979 | Longsworth | 62/55.5 |

*Primary Examiner*—Ronald C. Capossela

*Attorney, Agent, or Firm*—Stanley Z. Cole; Leon F. Herbert

[57] ABSTRACT

Two stage cryogenic pump having axially spaced baffle members for shielding the second stage from external thermal radiation while permitting substantially unimpeded gas flow from the inlet opening to the second stage.

10 Claims, 9 Drawing Figures

CRYOGENIC PUMP WITH RADIATION SHIELD

This is a continuation of application Ser. No. 79,860 filed Sept. 28, 1979.

This invention pertains generally to cryogenic pumping apparatus and more particularly to a two-stage cryogenic pump in which gases are removed by condensation and/or adsorption on progressively colder pumping surfaces.

In a two-stage cryogenic pump, the first pumping stage is typically maintained at a temperature on the order of 50° K.-80° K., and the second pumping stage is maintained at a colder temperature on the order of 10° K.-20° K. Gases such as water vapor and carbon dioxide are cryopumped by condensation at the higher temperature first stage, whereas gases such as oxygen, nitrogen, argon, helium, hydrogen and neon, which require a lower temperature for condensation or adsorption, are pumped at the second stage.

In order for a pump of this type to operate efficiently, the low temperature second stage must be shielded from external thermal radiation. In the past, a plurality of chevron shaped baffles arranged in an optically dense, generally planar array have been placed between the second stage and the chamber to be evacuated in order to shield the second stage from thermal radiation from the chamber. While providing the desired shielding, the dense baffle array interferes with the flow of gas into the pump. Thus, for example, a pump capable of removing 1,000 liters per second may have its flow rate reduced to 150-250 liters per second by the baffle array.

Copending application Ser. No. 930,953, filed Aug. 4, 1978 and assigned to the assignee herein, discloses an improved chevron baffle array configured to substantially enclose or surround the second stage. By providing a substantially enlarged area for gas access, this three dimensional array provides a significant reduction in the resistance of gas flow to the second stage, as compared with the more conventional planar array. However, the three dimensional array is relatively complex and expensive to manufacture.

It is in general an object of the invention to provide a new and improved cryogenic pump.

Another object of the invention is to provide a cryogenic pump of the above character having baffles for shielding the low temperature second stage from thermal radiation, while providing substantially unimpeded gas flow to the second stage.

Another object of the invention is to provide a cryogenic pump of the above character which is easy to fabricate and economical to manufacture.

These and other objects are achieved according to the invention by providing a cryogenic pump having an inlet opening for gaseous communication with the chamber to be evacuated, a first stage extending axially from the inlet opening, a second stage maintaned at a lower temperature than the first stage, and one or more baffle members of limited radial extent spaced axially apart between the first and second stages for shielding the pumping surface of the second stage from direct exposure to the inlet opening while permitting substantially unimpeded gas flow from the first stage to the second stage.

Figure 1:
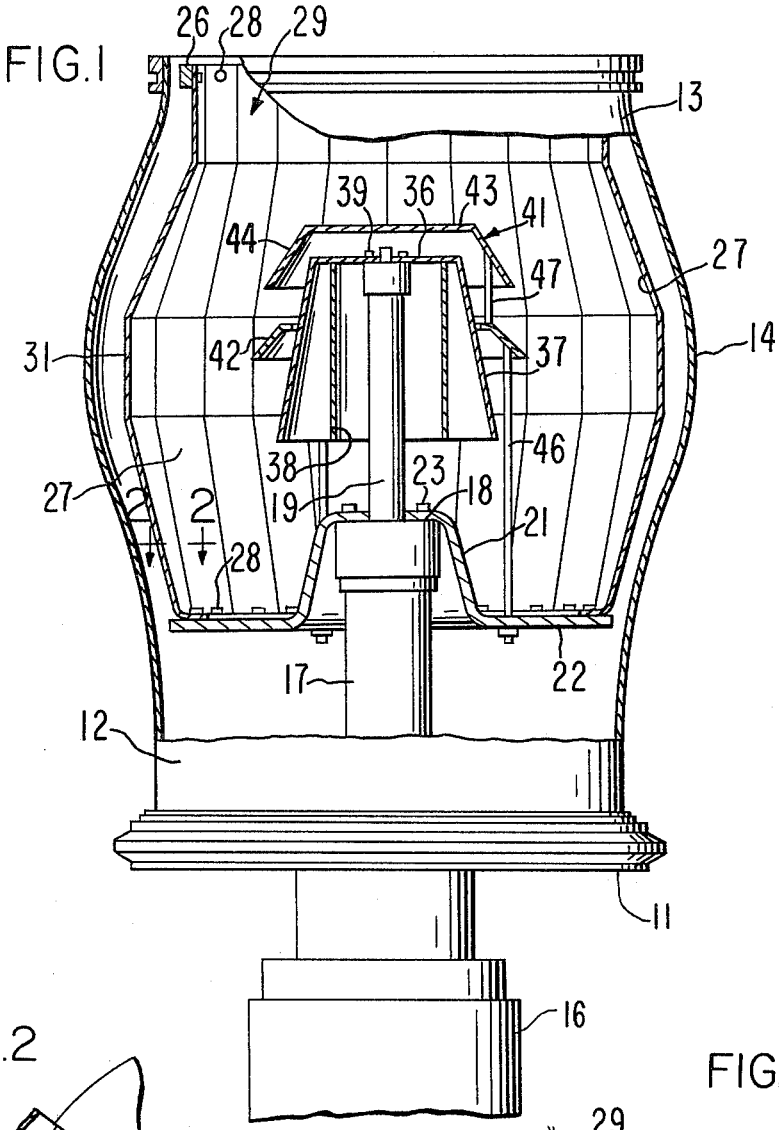
FIG. 1 is a side elevational view, partly broken away and partly schematic, of one embodiment of a cryogenic pump according to the invention.

As illustrated in FIG. 1, the pump includes a generally circular base plate 11 on which a generally cylindrical housing 12 is mounted. The upper end 13 of the housing is open to permit communication with the chamber to be evacuated, and the central portion 14 of the side wall bulges outwardly in the radial direction to permit unrestricted gas flow within the pump.

Cooling is provided by a closed-loop refrigeration system in which compressed helium gas is expanded in two successive stages. This system includes a two-stage expander 16 coupled to a remotely located compressor (not shown). The expander includes an elongated first stage 17 having an annular distal wall 18, and an elongated second stage 19. The first stage is typically maintained at a temperature on the order of 50° K.-80° K., and the second stage is maintained at a temperature on the order of 10° K.-20° K. The expander extends axially through base 11 and is secured thereto by suitable means (not shown).

The first stage of the pump includes a generally circular support plate 21 mounted on expander wall 18, with the outer portion 22 of the plate being offset below the expander wall. The support plate is secured to the expander wall by mounting screws 23 and is in intimate thermal contact with the expander wall. A mounting ring 26 is spaced above the support plate, and a plurality of axially extending leaves 27 are arranged circumferentially about the support plate and mounting ring to form a generally cylindrical pumping surface for the first stage. The leaves are secured to the support plate and ring by screws 28 to form a rigid structure, with an inlet opening 29 at the upper end thereof. Leaves 27 are bent to form an outward radial bulge 31 to provide reduction in the restriction to gas flow in the vicinity of the second stage of the pump.

The second stage of the pump includes a radially extending plate 36 mounted on the upper end of expander stage 19, with a depending frustroconical outer wall 37 and a depending cylindrical inner wall 38. The second stage is fabricated as a unitary structure and is in intimate thermal contact with the upper wall of the expander, to which it is secured by mounting screws 39. The second state is positioned coaxially within the first stage.

Means is provided for shielding the second stage of the pump from direct, line-of-sight radiation from the chamber to be evacuated. This means includes an upper baffle member 41 and a lower baffle member 42 spaced axially apart between the first and second stages. Baffle member 41 includes a generally planar central portion 43 positioned between inlet opening 29 and plate 36, with a frustroconical portion 44 extending downwardly and outwardly beside the upper portion of wall 37. Baffle member 42 comprises a frustroconical member spaced below baffle member 44, with a larger diameter than the frustroconical portion of baffle member 44. This spacing is sufficient to provide substantially unimpeded gas flow between the baffle members. The baffle members are maintained at the temperature of the first stage and are spaced away from the walls of the second stage. The lower baffle member is supported by posts 46 mounted on support plate 21, and the upper baffle member is supported by posts 47 extending between the baffle members.

In the preferred embodiment, the outer surfaces of leaves 27 are made highly reflective, as by nickel plating, and the inside of pump housing 12 is electropolished to reduce radiant heat transfer between these bodies. The upper surfaces of baffle members 41, 42 are also made highly reflective, as by nickel plating, so that radiant energy from external sources will be reflected to the walls of the first stage or out of the pump through the inlet opening. The inner surfaces of leaves 27 are blackened to prevent external thermal radiation from being reflected to the second stage. The inner surfaces of the second stage (i.e., the lower surface of plate 36, the inner surface of wall 37, and the inner and outer surfaces of wall 38) are preferably coated with a cryosorbent material such as activated charcoal or an artificial zeolite.

Figure 2:
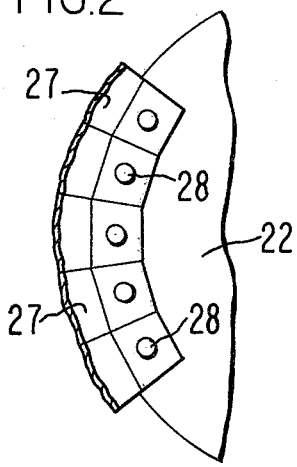
FIG. 2 is a fragmentary cross-sectional view taken along line 2—2 in FIG. 1.
Figure 3:
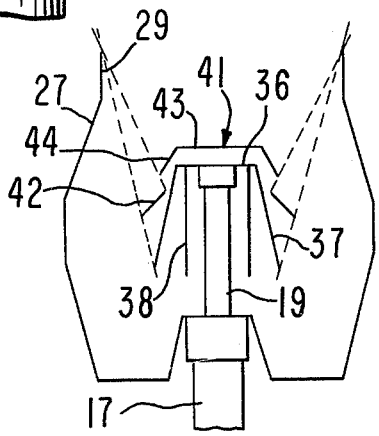
FIG. 3 is a schematic view illustrating the operation of the baffle members in the embodiment of FIG. 1.

Operation and use of the embodiment of FIGS. 1–3 is as follows. A chamber to be evacuated is connected in gaseous communication with inlet opening 29, and the compressor connected to expander 16 is actuated to maintain the first pumping stage at a temperature on the order of 50° K.–80° K. and the second pumping stage at a temperature on the order of 10° K.–20° K. Gases such as water vapor and carbon dioxide condense on the pumping surface formed by the inner walls of leaves 27 in the first pumping stage. Gases such as helium, hydrogen and neon are adsorbed on the inner wall surfaces of the second stage, while gases such as oxygen, nitrogen and argon are pumped on all second stage surfaces by condensation. Upper baffle member 41 prevents external thermal radiation from falling on the portion of the second stage above baffle member 42, and baffle member 42 prevents external radiation from reaching the lower portion of the second stage. Being spaced from the second stage and from each other, the baffle members do not interfere appreciably with the flow of gas to the second stage.

The embodiments of FIGS. 4–9 are generally similar to the embodiment of FIGS. 1–3 except for the baffle structure, and like reference numerals are utilized to designate common elements in the different embodiments. In FIGS. 3–9, the dotted lines indicate the outer boundaries of line-of-sight radiation entering the cryopump through the inlet opening from the chamber.

Figure 4:
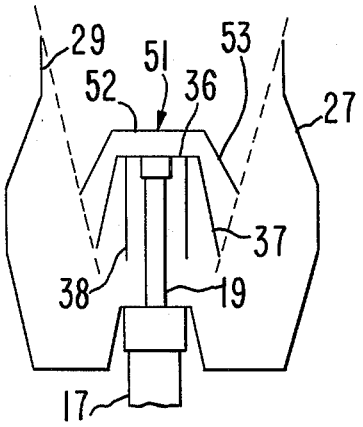
FIGS. 4-9 are schematic elevational views of additional embodiments of cryogenic pumps according to the invention.

In the embodiment of FIG. 4, a single baffle member 51 is employed. This baffle member has a generally planar central portion 52 and a depending frustroconical outer portion 53. The central portion of the baffle member is positioned axially between the inlet opening and upper plate 36 of the second pumping stage, and frustroconical portion 53 is of sufficient length to shield the entire outer surface of wall 37 from direct thermal radiation through inlet opening 29. The angle of inclination of frustroconical portion 53 is chosen to provide maximum gas flow from the inlet opening to the second stage.

Figure 5:
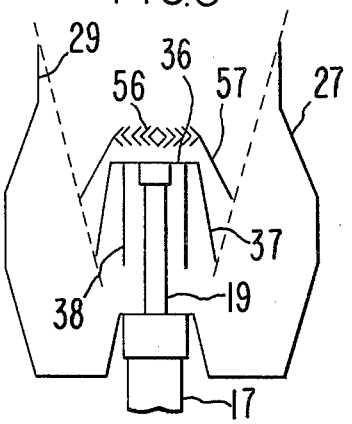

The embodiment of FIG. 5 is similar to the embodiment of FIG. 4, with a concentric array 56 of chevron-shaped baffle members being utilized instead of a solid plate for shielding the upper portion of the second stage. This structure includes a frustroconical outer portion 57 similar to element 53 of FIG. 4. This embodiment provides additional gas access to the second-stage pumping structure through baffle array 56.

Figure 6:
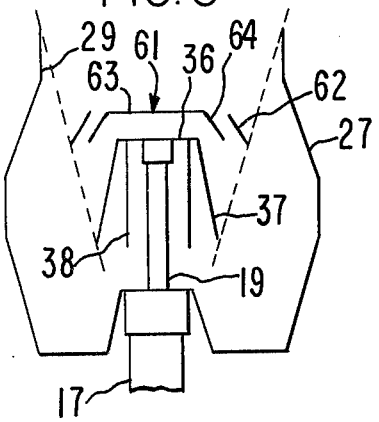

In the embodiment of FIG. 6, the radiation shield comprises an inner baffle member 61 spaced axially above the second stage and an outer baffle member 62 positioned coaxially of and generally coplanar with baffle member 61. Baffle member 61 includes a generally planar central portion 63 and a depending frustroconical outer portion 64. Baffle member 62 is a frustroconical baffle of larger diameter than the frustroconical portion of baffle member 61. The inner baffle member shields the upper portion of the second stage from external radiation, and baffle member 62 shields the lower portion of the stage. As in the other embodiments, the spacing and size of the baffle members is such that the gases can flow freely between the baffle members and the walls of the stages.

Figure 7:
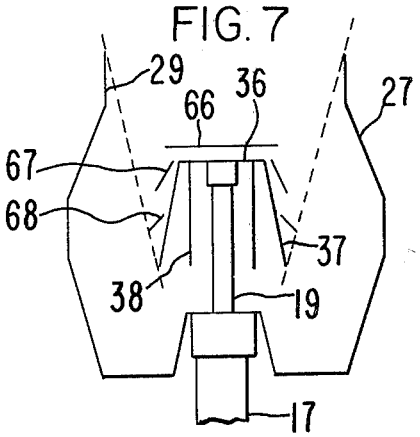

In the embodiment of FIG. 7, the radiation shield includes a baffle plate 66 above the second pumping stage and a pair of frustroconical baffle members 67, 68 spaced axially apart adjacent to wall 37. Plate 66 is of greater diameter than upper plate 36 of the second stage, and lower baffle 68 is of greater diameter than upper baffle 67.

Figure 8:
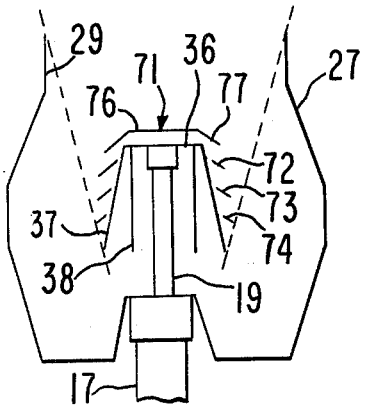

In the embodiment of FIG. 8, the radiation shield comprises one baffle member 71 positioned above the second stage and a plurality of baffle members 72–74 spaced axially apart beside the second stage. Baffle member 71 includes a generally planar central portion 76 and a frustroconical outer portion 77. Baffle members 72–74 are frustroconical and are of increasingly larger diameter toward the bottom of the second stage.

Figure 9:
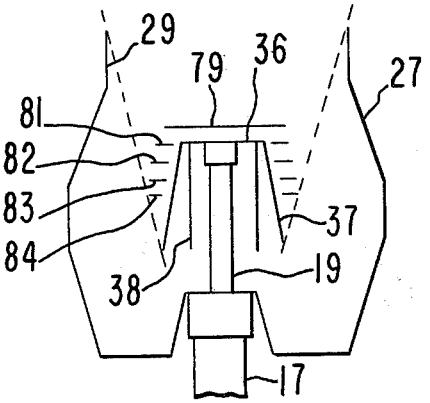

In the embodiment of FIG. 9, the thermal shield comprises a generally circular plate 79 positioned above the second stage and a plurality of radially extending annular plates 81–84 spaced axially apart beside the second stage, with the annular plates increasing in diameter toward the bottom of the stage. Being spaced apart and of limited radial extent, these baffle plates permit relatively unimpeded gas flow to the second stage while shielding that stage from external thermal radiation.

Although the first pumping stage and the pump housing are shown as having radially bulging side walls for improved gas flow in the embodimengs illustrated, it will be understood that the invention is not limited to this particular wall structure and that the baffle structures disclosed herein can also be employed with straight cylindrical walls or any other suitable wall structure.

It is apparent from the foregoing that a new and improved cryogenic pump has been provided. While only certain presently preferred embodiments have been described in detail, as will be apparent to those familiar with the art, certain changes and modifications can be made without departing from the scope of the invention as defined by the following claims.

What is claimed is:

1. In a cryogenic pump for removing gaseous species from a chamber: a first stage having an inlet opening at one end thereof for gaseous communication with the chamber and a generally cylindrical pumping surface maintained at a first temperature for removing a portion of the gaseous species, a second stage positioned coaxially within the first stage and having a pumping surface maintained at a temperature lower than the first temperature for removing an additional portion of the gaseous species, and a plurality of baffle members spaced axially apart between the first and second stages for shielding the pumping surface of the second stage from direct exposure to the inlet opening while permitting substantially unimpeded flow of the gaseous species from the inlet opening to the second stage.

2. The cryogenic pump of claim 1 wherein the pumping surface of the first stage is blackened to prevent reflection of thermal energy from the inlet opening to the pumping surface of the second stage.

3. The cryogenic pump of claim 1 wherein the baffle members include a first baffle member having a generally planar portion positioned axially between the inlet opening and the second stage and a frustroconcial portion extending outwardly from the generally planar portion and away from the inlet opening, and a second baffle positioned radially adjacent the second stage and having a frustroconical wall of larger diameter than the frustroconical portion of the first baffle member.

4. The cryogenic pump of claim 1 wherein the baffle members include radially extending annular plates.

5. The cryogenic pump of claim 1 wherein the first stage comprises a ring adjacent the inlet opening, a support plate at the end of the stage opposite the inlet opening, and a plurality of individual leaves extending between the ring and plate to form the generally cylindrical pumping surface.

6. The cryogenic pump of claim 5 wherein the leaves are formed to provide a radial bulge for increased gas flow in the vicinity of the second stage.

7. The cryogenic pump of claim 1 wherein the baffle members are maintained at substantially the temperature of the first stage.

8. In a cryogenic pump for removing gaseous species from a chamber: means forming an inlet opening for gaseous communication with the chamber, a first stage extending axially from the inlet opening and having a pumping surface maintained at a first temperature for removing a portion of the gaseous species, a second stage having a pumping surface maintained at a temperature lower than the first temperature for removing an additional portion of the gaseous species, and a baffle member having a frustroconical portion extending outwardly and away from the inlet opening for shielding the pumping surface of the second stage from direct exposure to the inlet opening while permitting substantially unimpeded flow of the gaseous species from the inlet opening to the second stage.

9. In a cryogenic pump for removing gaseous species from a chamber: a first stage having an inlet opening at one end thereof for gaseous communication with the chamber and a generally cylindrical pumping surface maintained at a first temperature for removing a portion of the gaseous species, a second stage positioned coaxially within the first stage and having a pumping surface maintained at a temperature lower than the first temperature for removing an additional portion of the gaseous species, the pumping surface of the first stage being blackened to prevent reflection of thermal energy from the inlet opening to the pumping surface of the second stage, a first baffle having a first portion positioned axially between the inlet opening and the second stage and a frustroconical portion extending outwardly from the first portion and away from the inlet opening, and a second baffle member of frustroconical shape positioned radially adjacent the second stage and having a greater diameter than the frustroconical portion of the first baffle member, said baffle members being maintained at substantially the temperature of the first stage and shielding the pumping surface of the second stage from direct exposure to the inlet opening while permitting substantially unimpeded flow of the gaseous species from the inlet opening to the second stage.

10. In a cryogenic pump for removing gaseous species from a chamber: a first stage having an inlet opening at one end thereof for gaseous communication with the chamber and a generally cylindrical pumping surface maintained at a first temperature for removing a portion of the gaseous species, a second stage positioned coaxially within the first stage and having a pumping surface maintained at a temperature lower than the first temperature for removing an additional portion of the gaseous species, and a plurality of baffle members, said baffle members being spaced axially apart, said baffle members increasing in radial extent away from the inlet opening, and said baffle members being positioned between the first and second stages for shielding the pumping surface of the second stage from direct exposure to the inlet opening while permitting substantially unimpeded flow of the gaseous species from the inlet opening to the second stage.

* * * * *